United States Patent [19]

Erlichman

[11] 4,401,218

[45] Aug. 30, 1983

[54] PACKAGE FOR HERMETICALLY STORING A SHRINKABLE ELASTOMERIC SLEEVE

[75] Inventor: Max Erlichman, Sunnyvale, Calif.

[73] Assignee: Insulation Systems, Inc., Sunnyvale, Calif.

[21] Appl. No.: 375,815

[22] Filed: May 7, 1982

[51] Int. Cl.[3] ..... B65D 85/20

[52] U.S. Cl. ..... 206/446; 206/484; 206/819

[58] Field of Search ..... 206/446, 497, 216, 582, 206/484, 848.2, 819

[56] References Cited

U.S. PATENT DOCUMENTS

| | | | |
|---|---|---|---|
| 3,182,890 | 5/1965 | Elam | 206/446 |
| 3,388,792 | 6/1968 | Jones | 206/446 |
| 3,587,201 | 6/1971 | Strayer | 206/446 |
| 4,018,337 | 4/1977 | Barnett | 206/484 |
| 4,058,632 | 11/1977 | Evans et al. | 206/484 |
| 4,135,622 | 1/1979 | Glick | 206/484 |

*Primary Examiner*—Joseph Man-Fu Moy

[57] ABSTRACT

A package is provided for a storage of dilated protective elastomeric sleeve of the type which shrinks upon exposure to ambient air. The package is formed by two concentrically arranged tubular members, one of which is positioned over the sleeve. Both tubular members have a length exceeding the length of the sleeve. The ends of the inner tubular member are sealed to the interior surface of outer tubular member, thereby forming a hermetically sealed chamber within which the sleeve is disposed. The ends of the outer tubular member are then sealed to completely close the package.

9 Claims, 8 Drawing Figures

PACKAGE FOR HERMETICALLY STORING A SHRINKABLE ELASTOMERIC SLEEVE

This invention relates to a new and approved package for storing shrinkable protective tubing. More particularly, it relates to a package for hermetically storing a chemically dilated elastomeric sleeve of the type which shrinks upon exposure to ambient air.

It is known in the art, and forms no part of this invention, that certain types of elastomeric tubing can be used for protecting joints, fittings and welds, so long as such tubing is able to shrink into tight and intimate contact with the surface which it surrounds. One well known form of such tubing is the heat shrinkable type, which, when applied over a joint and subjected to heat, shrinks tightly into contact with the members forming the joint. Another lesser known but still widely used type of shrinkable tube, and that which is the subject of the packaging of the present invention, is a shrinkable protective tube which has been treated with chemicals to bring the same to a dilated or enlarged state. This type of tubing will remain in its dilated or enlarged state so long as it is kept out of contact with the air. However, once the tubing is brought into contact with the surrounding air, it tends to shrink back to its initial size, without any application of heat, and simply by the contact of the air against the sleeve.

Packaging for the heat shrinkable type of such tubing is known and is disclosed, for example, in U.S. Pat. Nos. 4,188,979 and 4,245,674 to Nakamura et al. However, for the other variety of shrinkable tubing, namely, the chemically dilated type which shrinks upon contact with ambient air, it is necessary that such tubing initially be placed in some type of hermetically sealed container which will enable the tubing to remain dilated, and keep it from shrinking, until the container or package is opened. Obviously, any evacuated and hermetically sealed form of envelopes, pouch, or other package would normally be considered suitable for this purpose.

It has been found, however, that the normal type of packaging for such chemically dilated tubing is ineffective in certain conditions of usage, particularly those where the package must be opened to start the installation, yet where the shrinkage will not be permitted for some period of time. Typically, such chemically dilated shrinkable tubing shrinks from its dilated form to its original size in about 10 to 30 minutes after contact with the air. Yet, in certain types of installations, such as pipe welds for corrosion protection or underground electrical power cable splices, it is necessary that the shrinkage not occur for periods from 1 up to 6 hours.

Obviously, for any such dialated tubing or protective sleeve, it is necessary to place the same in the area where it will be used prior to final formation of the fitting or joint. Thus, for example, if two pipes are to be welded together and protected by shrinkable tubing, it is necessary that the tubing be applied over one of the pipes before they are connected, and that the weld then be formed. Similarly, if two cables are to be spliced together, it is necessary that the protective tubing or sleeve be applied over one of the cables and that the splice then be formed. Thereafter, after the weld or splice is formed, the sleeve is slid over the area of juncture and permitted to shrink. However, in normal installations, and using normal packaging techniques, the shrinkable tubing or sleeve would itself shrink into contact with the pipe or cable running through it, long before the weld or splice was ever completed. For this reason, it is apparent that a new and unique form of packaging must be provided for this type of shrinkable tubing or sleeve.

With the foregoing in mind, it is therefore an object of the present invention to provide such a new and unique form of packaging.

Another object of the present invention is to provide a package for hermetically sealing a protective elastomeric sleeve of the type which shrinks upon exposure to ambient air.

Another object of the present invention is to provide a composite package for shrinkable elastomeric tubing or sleeves, which package can be partially opened to permit the tubing or sleeve to be placed in the environment where it will be used, yet which will still keep the tubing or sleeve hermetically sealed until the juncture which it is to protect has been completed.

Other objects, advantages and salient features of the present invention will become apparent from the following detailed description, which, taken in conjunction with the annexed drawings discloses a preferred embodiment thereof.

The foregoing objects are generally obtained by providing a package formed by a pair of concentrically arranged members forming an inner and an outer member. The inner member is disposed within the shrinkable elastomeric sleeve and the outer member is disposed in surrounding relationship to that sleeve. Both the inner and the outer members have a length exceeding that of the sleeve. The inner member has its ends sealed to the interior surface of the outer member, therefore forming an annular passage within which the sleeve is hermetically sealed. Then, the end portions on the outer member are themselves closed and sealed to thus provide a completely closed package which further protects the hermetic sealing in the interior thereof.

Referring now to the drawings which form a part of this original disclosure:

Figure 1:
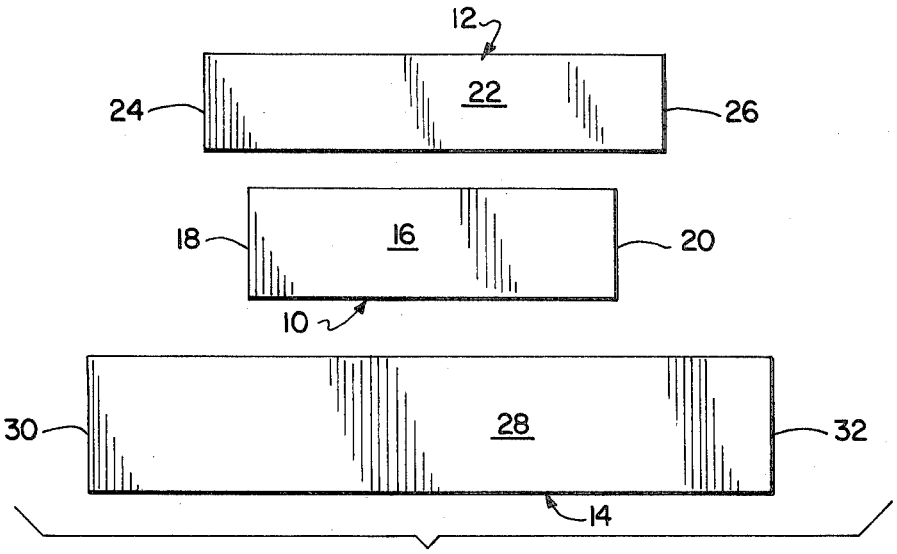
FIG. 1 is an elevational view showing the three components which form the package of the present invention, namely, the inner and outer members and the protective sleeve.

Referring now to the drawings in further detail, there is shown in FIG. 1 the protective elastomeric tubing or sleeve which is generally designated 10, the inner member or pouch which is generally designated 12 and the outer member or pouch which is generally designated 14. These are the three elements which, when assembled together, form the package of the present invention.

The elastomeric sleeve 10 is simply a hollow tubular member formed from any suitable and stretchable material such as rubber or plastic. A suitable material for the sleeve 10 can be a silicone rubber.

As previously explained, the sleeve 10 is chemically dilated, and in its illustration in FIG. 1, it is shown in its dilated form. Such dilation is chemically accomplished, for example, by application of a fluorocarbon solvent onto the silicone rubber of the sleeve 10. This will cause the sleeve to become enlarged in size or dilated. When that solvent evaporates or volatilizes by exposure to ambient air, the sleeve will simply shrink from its dilated or enlarged size back to its original size.

The elastomeric material forming the continuous sidewall of the sleeve 10 is designated 16. The opposed ends 18 and 20 of the sleeve 10 are illustrated as being perpendicular to the axis of elongation of the sleeve 10. Therefore, as is apparent, the sleeve 10 is formed as a right cylinder having a continuous wall 16 formed of material just discussed.

The inner pouch or member 22 is likewise illustrated as a right cylindrical member having a diameter less than that of the dilated sleeve 10, but having a length exceeding the length of the dilated sleeve 10. The continuous sidewall 22 on the inner pouch or member 12 forms its body and the opposed ends 24 and 26 are formed perpendicularly to the axis of elongation of the member 12.

Finally, the outer pouch or member 14 has a continuous sidewall 28 and opposed ends 30 and 32. The length of the outer member 14 between its ends 30 and 32 exceeds the length of both the sleeve 10 and the inner member 12. Similarly, the internal size of the tubular outer member 14 is larger than that of the dilated sleeve 10 so that the outer member can be slipped over the dilated sleeve. Again, the ends 30 and 32 of the outer member are illustrated as perpendicular to its axis of elongation, thereby making the member 14 a right cylindrical member as well.

Figure 2:
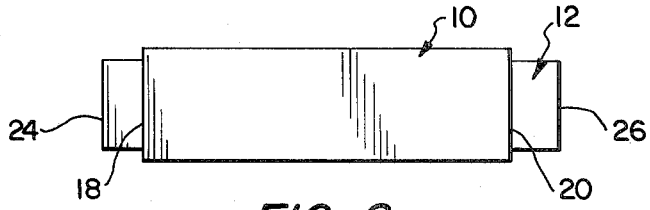
FIG. 2 is an elevational view showing the inner member and the sleeve as they are initially assembled.

As part of the initial assembly, and as illustrated in FIG. 2, the inner member or pouch 12 is positioned concentrically within the dilated protective sleeve 10 such that the end portions of the inner member 12 project beyond the ends 18 and 20 of the protective sleeve 10.

Figure 3:
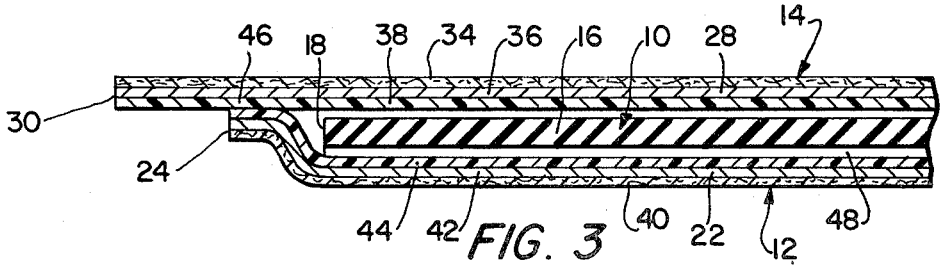
FIG. 3 is an enlarged fragmentary sectional view of the inner and outer members as joined together, with the sleeves being provided in the chamber therebetween.

Referring now to FIG. 3, it can be noted that the material forming the wall 22 of the inner member 12 and forming the wall 28 of the outer member 14 is a laminate. The laminate is formed of the same three component layers, namely, a paper layer, a central metallic foil layer and a plastic or polyoleofin layer, advantageously polyethylene. On the wall 28 of the outer member, the paper layer 34 forms the outer surface, the foil layer 36 forms the center or intermediate layer and the poly material 38 forms the inner layer or interior surface of the member 14. For the member 12, the laminate is exactly reversed. That is, the paper layer 40 forms the interior surface, the foil layer 42 still forms the center or intermediate layer, and the poly surface 44 forms the outer or exterior layer.

As illustrated in FIG. 3, the end portion on the inner member 12 is sealed against the outer member or pouch 14, at an area identified as 46. As can be seen, at this sealing area 46, the poly layer 38 on the outer pouch and the poly layer 44 on the inner pouch are contacted against one another, and are suitably adhered or cohered together to form a tight seal. This can be accomplished by heat sealing or by any other suitable production technique. In practice, one end would be sealed as shown at 46, the sleeve 10 would be inserted between the inner and outer pouch members, and the other end would then be similarly sealed.

As a result of the arrangement shown in FIG. 3, an annular chamber 48 is formed between the inner and outer pouch members and having length extending from the sealed portion 46 at one end of the package to the sealed portion 46 at the other end thereof. The dilated protective sleeve 10 is inserted into this annular chamber 48. Insofar as possible, the chamber 48 is evacuated during the formation of the package, and the result is that the chamber 48 forms a hermetically sealed chamber within which the sleeve is positioned.

Figure 4:
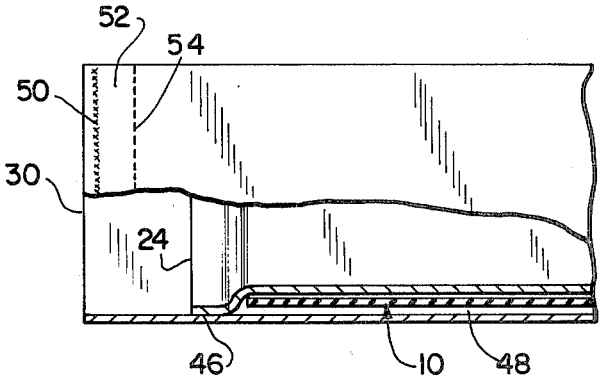
FIG. 4 is a fragmentary elevational view, partly in section, showing the entire package as it is closed and sealed together.

Continuing now with reference to FIG. 4, the package is completely closed by sealing the ends of the outer member as illustrated at 50. Again, such sealing can be accomplished by heat sealing or by any suitable adhesive or cohesive means. And, once again, the interior of the package is evacuated as much as possible during the formation and prior to the sealing at 50, so that the result and final package is essentially flat in configuration.

Figure 5:
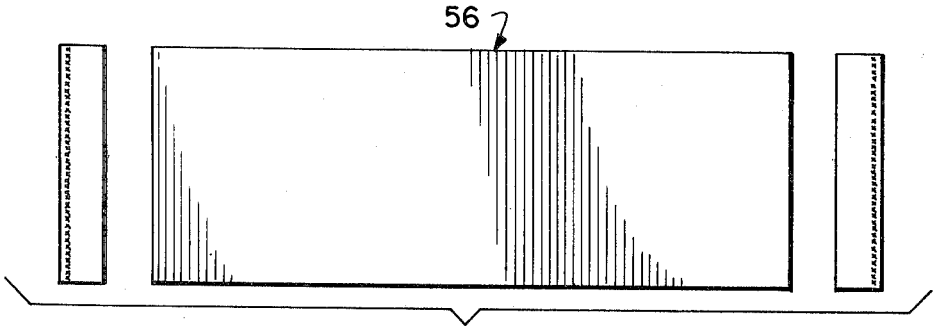
FIG. 5 is a diagramatic view showing the package as it can be opened by removing the closed ends of the outer member thereof.

In the marginal area 52 between the sealed area 46 and the end seal 50, a designated opening line 54 is provided. This can simply be indicia imprinted on the outer paper layer 34 of the outer pouch member, or it can be a score line or other area of weakening. The concept for this indicia line 54, however, is to simply provide a marking area so that when the package is to be opened, as illustrated in FIG. 5, it can be torn, cut, or otherwise severed along the line 54 at each end of the package. When such removal of the ends occurs, a resultant package generally designated 56 is provided. That resultant package contains the major portion of the outer pouch member 14, it contains the inner pouch member 12 still sealed to the outer pouch member at 46, it contains the annular chamber 48 and it contains the dilated protective sleeve 10 within that annular chamber.

Figure 6:
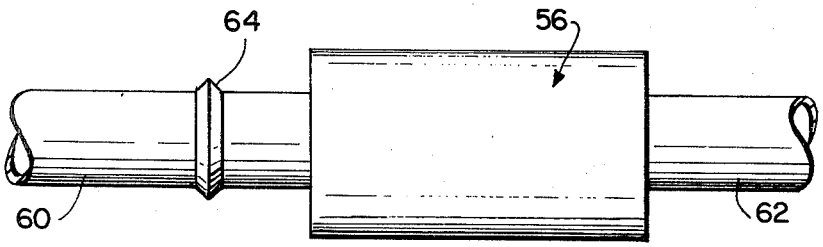
FIG. 6 is a diagramatic view showing how the remaining packaging from FIG. 5 is placed into the environment of use.
Figure 7:
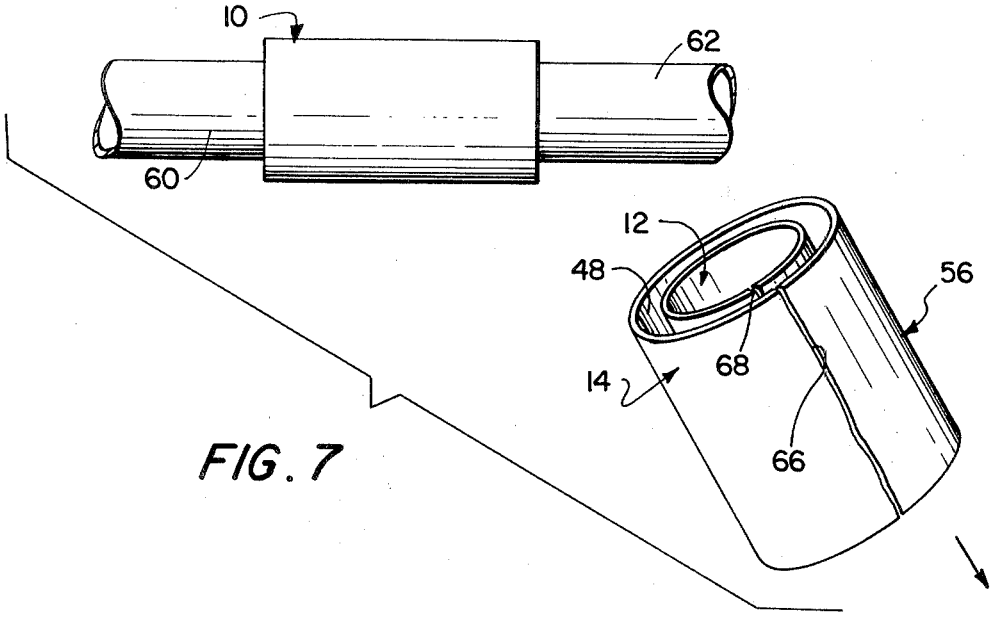
FIG. 7 is a diagramatical view illustrating how the remaining packaging is removed and how the sleeve is applied over the member to be sealed.
Figure 8:
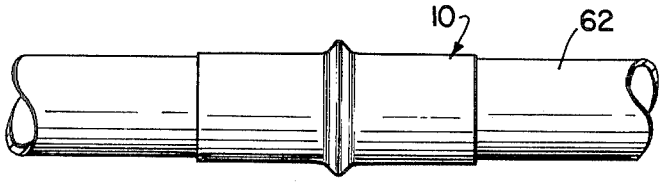
FIG. 8 is a diagramatic view showing the tubing shrunken into position after exposure to the air.

Referring now to FIGS. 6, 7 and 8, such Figures illustrate the manner in which the package of the present invention would be utilized and opened in normal use. In FIG. 6, two elongated pipes 60 and 62 are to be joined together at a juncture 64. This juncture, for purposes of illustration, can be assumed to be one which will be welded together. Before the pipes are brought together at the juncture 64, the remaining package 56 is slipped over one of the pipes 62. It can then be kept to one side, as shown in FIG. 6, while the weld is made along the juncture 64.

Once the weld has been completed and has been permitted to cool for a sufficient time, the operator is then ready to install the protective sleeve 10 over the weld. One end of the remaining package 56 is opened, as by simply slipping the seal 46 with a sharp knife or razor, thereby permitting the dilated sleeve 10 to be removed from the chamber 48. The sleeve 10 is placed in position and the remainder of the package is removed as by cutting the same as illustrated at 66 and 68, as shown in FIG. 7.

Finally, as shown in FIG. 8, after the sleeve of FIG. 7 has been permitted to remain in its position for a relatively short period of time, exposed to the ambient air, that sleeve will shrink back to its original size and in doing so will form a protective layer which completely overlies the juncture 64, as well as that portion of the pipes 60 and 62 at either side of the juncture.

After reading the foregoing detailed description, it will be apparent to those skilled in the art that various changes may be made in materials, sizes, and other non-essential features of the invention, without departing from the spirit and scope of the invention as defined in the accompanying claims.

What is claimed is:

1. A package for hermetically storing a protective elastomeric sleeve which shrinks upon exposure to ambient air, said package comprising:

a pair of tubular pouches, one disposed within the other, to form an inner and an outer pouch;

a chemically dilated elastomeric sleeve of the type which shrinks upon exposure to ambient air, said sleeve being disposed between said inner and outer pouches, with the inner pouch being disposed within the sleeve and the other pouch being positioned over said sleeve;

said sleeve being of shorter length than said pouches, thereby permitting the ends of said pouches to project beyond the ends of said sleeves;

said inner pouch having its ends secured to the interior of said outer pouch to form a closed chamber within which said sleeve is hermetically sealed;

said outer pouch having end portions extending beyond that area where said inner pouch ends are secured;

said outer pouch end portions being sealed closed, thereby sealing the interior of said outer pouch.

2. A package as defined in claim 1 where in a marginal area is defined between each sealed end portion of the outer pouch and the adjacent area where the inner pouch ends are secured.

3. A package as defined in claim 2 wherein said marginal area includes a weakened portion to enable the sealed outer pouch end portions to be separated and removed.

4. A package as defined in claim 3 wherein said pouches are formed of a laminate having a paper layer on one side, a polyolefin layer on the other side, and a foil layer in the center.

5. A package as defined in claim 4 wherein said outer pouch has the paper layer as its exterior surface and the polyolefin layer as its interior surface.

6. A package as defined in claim 5 wherein said inner pouch has the polyolefin layer as its exterior surface and the paper layer as its interior surface.

7. A package as defined in claim 6 wherein said inner pouch ends are secured by sealing the polyolefin layer on the exterior of said inner pouch against the polyolefin layer on the interior of said outer pouch.

8. A package for hermetically protecting a dilated protective elastomeric sleeve of the type which shrinks upon exposure to ambient air until such sleeve is ready for use, said package comprising:

an axially elongated elastomeric sleeve which is chemically dilated to an enlarged size and which, when brought into contact with ambient air, shrinks to a smaller size;

a first flexible elongated tubular member having a diameter less than that of the plastic sleeve and having a length greater than the length of the plastic sleeve;

said first tubular member being disposed within said plastic sleeve and having end portions projecting beyond the ends of said plastic sleeve;

a second flexible elongated tubular member having a diameter greater than that of said plastic sleeve and having a length exceeding both the length of the plastic sleeve and the length of said first tubular member;

said second tubular member being disposed over, and in surrounding relationship to, the plastic sleeve and the first tubular member within said plastic sleeve;

said first tubular member having its end portions sealed against the interior surface of said second tubular member, thereby forming a hermetically sealed chamber within which said plastic sleeve is positioned;

said second tubular member having opposed end sections, said end sections being sealed closed to block off access to the interior of said second tubular member.

9. A package as defined in claim 8 wherein said first tubular member has a plastic coating on its exterior and wherein said second tubular member has a plastic coating on its interior, said plastic coatings being adhered together where said end portions are sealed.

* * * * *